United States Patent [19]

Hench

[11] Patent Number: 5,042,733

[45] **Date of Patent: * Aug. 27, 1991**

[54] ROTARY CUTTER, PARTICULARLY FOR GRANULATING PLASTIC MATERIAL

[76] Inventor: Hans Hench, Sonnhalde 31, D-7854 Inzlingen, Fed. Rep. of Germany

[ * ] Notice: The portion of the term of this patent subsequent to Jun. 26, 2007 has been disclaimed.

[21] Appl. No.: 563,290

[22] Filed: Aug. 6, 1990

[51] Int. Cl.[5] ..... B02C 18/18

[52] U.S. Cl. ..... 241/294; 144/2 N; 144/231; 407/46; 407/48

[58] Field of Search ..... 241/294; 144/2 N, 231; 407/46, 47, 48, 51

[56] References Cited

U.S. PATENT DOCUMENTS

| | | | |
|---|---|---|---|
| 2,874,912 | 2/1959 | Sennholtz et al. | 241/294 X |
| 3,838,826 | 10/1974 | Wallace et al. | 241/294 X |
| 3,899,813 | 8/1975 | Lovendahl | 241/294 X |
| 3,946,474 | 3/1976 | Hahn et al. | 241/294 X |
| 4,546,929 | 10/1985 | Fritsch et al. | 241/294 |
| 4,785,860 | 11/1988 | Arasmith | 241/294 X |
| 4,826,090 | 5/1989 | Orphall | 241/294 X |
| 4,930,710 | 6/1990 | Hench | 241/294 |
| 4,936,516 | 6/1990 | Hench | 241/294 |

FOREIGN PATENT DOCUMENTS

| | | | |
|---|---|---|---|
| 096083 | 12/1983 | European Pat. Off. . | |
| 182037 | 5/1986 | European Pat. Off. . | |
| 0266447 | 5/1988 | European Pat. Off. . | |
| 0344348 | 12/1989 | European Pat. Off. | 241/294 |
| 0357549 | 3/1990 | European Pat. Off. | 241/294 |
| 2724464 | 11/1978 | Fed. Rep. of Germany . | |
| 3334783 | 3/1984 | Fed. Rep. of Germany | 241/294 |
| 3301919 | 7/1984 | Fed. Rep. of Germany . | |
| 419807 | 3/1967 | Switzerland . | |

*Primary Examiner*—Mark Rosenbaum
*Assistant Examiner*—Frances Chin
*Attorney, Agent, or Firm*—Frishauf, Holtz, Goodman & Woodward

[57] ABSTRACT

To retain elongated removable cutter elements (9, 90) on an axially elongated cylindrical body structure (1, 1'), eccentric holding plugs (27, 30, 300) are directly or indirectly engageable with the cutter elements so that the cutter elements can be clamped in grooves (5) with converging side walls, by engaging the eccentric elements either directly against the cutter elements (FIG. 4) or indirectly via a resiliently deflectable or deformable portion (16) of the tool body (1, 1'). The tool body can be formed as an open cage structure (1') (FIGS. 5-8) to permit granulated plastic material to fall between rods or rails (34) formed with the grooves (5) in which the cutter elements (9, 90) are retained by the eccenters (27).

23 Claims, 6 Drawing Sheets

Fig. 4
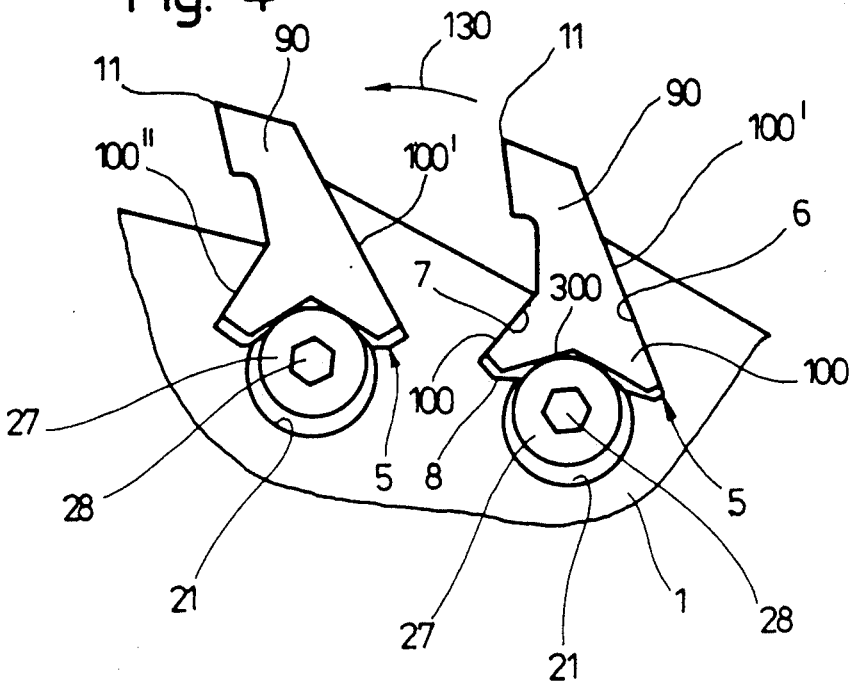
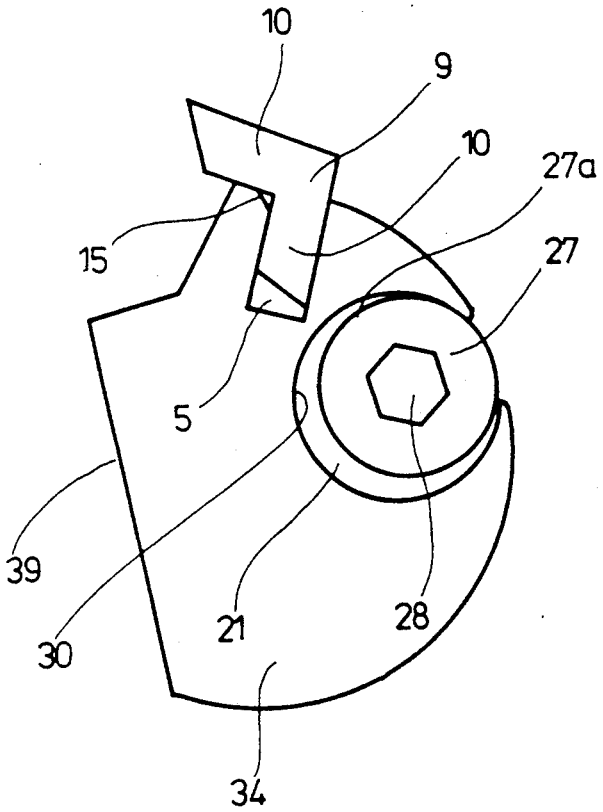
Fig. 6
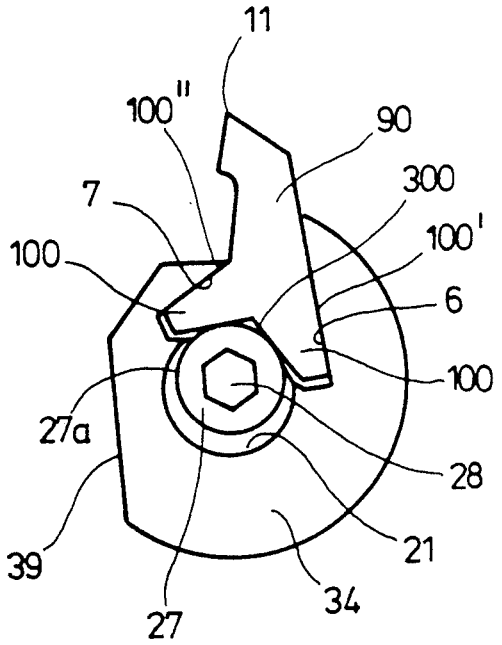
Fig. 7

ROTARY CUTTER, PARTICULARLY FOR GRANULATING PLASTIC MATERIAL

Reference to related patents, the disclosure of which is hereby incorporated by reference:

U.S. Pat. No. 4,936,516, Hench
U.S. Pat. No. 4,930,710, Hench
U S. Pat. No. 4,546,929, Fritsch et al
Reference to related publications:
European 85 111 998
European 182 037, Fritsch et al
European 096 083, Fritsch et al
German 27 24 464, Hench, Sen.
German 33 01 919, Keller
Swiss 419,807, von der Ohe.

FIELD OF THE INVENTION

The present invention relates to a rotary cutting tool particularly adapted for shredding or comminuting or granulating plastic material, and especially elongated plastic material which may have reinforcing fibers or strands or the like embedded therein.

BACKGROUND

Cutting tools for shredding materials usually have a rotary body structure formed with essentially axially extending grooves into which cutter bits, for example in strip form, can be inserted. They are held in the groove by suitable clamping arrangements The cutter bits should be replaceable since they wear. Usually, the direction of the cutter bits or strips is slightly inclined with respect to the axis of rotation of the tool, for example by about 2° to 3°.

The cutter bits or strips are usually made of ceramic, such as stellite, a hard metal, such as tool steel or the like. These cutter bits or strips are highly stressed, particularly when comminuting or granulating plastic materials which include fillers. The cutter elements must be replaceable so that, when worn, they can be exchanged or re-sharpened.

A cutting tool for granulated plastic material is shown in German Patent 34 39 029 (to which European Published Application 182 037, Fritsch and Hench, corresponds). Clamping arrangements located at the circumference of the tool body are provided. The tool body has longitudinal grooves which define oppositely located clamping surfaces. In the bottom or root region, the cutter elements have suitable clamping surfaces, for example in form of an essentially V-groove, which are in engagement with the clamping surfaces, for proper orientation and matching force transferring fit. The clamping arrangement further includes balls which are radially clamped by the V-surfaces of the tool body.

The clamping arrangement for the cutter strips thus is highly effective, and provides for interlocking interengagement holding of the cutter strips; yet, difficulties arose upon exchange of the cutter elements in the field, since the balls could get lost and could fall out of the groove upon exchange of cutter strips.

It has also been proposed, see Published European Patent Application 85 111 989, to replace the balls by essentially cylindrical clamping sleeves which are formed with a slit extending over a portion of their length and which, in the region of their bore, are formed with interior conical or wedge-like clamping surfaces which engage against a clamping screw which is threaded into the bore of the sleeve. This, also, is an effective clamping system for the cutter strips. It is, however, quite difficult to tighten and, after tightening, to release the clamping strips. The screwing-in and screwing-out of the threaded screws is comparatively time-consuming, complex, and must be carried out carefully and hence requires skilled operators and careful attention to the task.

THE INVENTION

It is an object to provide a rotary cutting tool, particularly adapted for granulating, comminuting or shredding plastic material, and especially reinforced plastic material, which has replaceable cutter strips secured to a body structure, and which is so arranged that the cutter strips can be easily clamped and unclamped and released, and hence exchanged, and which, preferably additionally, provides for positive seating of the cutter strips on the surface of the tool body structure.

Briefly, the cutter strips are clamped in position in respective clamping grooves formed in the tool body structure by eccenters which are rotatable, and operatively act on the cutter elements in the grooves, either directly by direct engagement with the cutter elements, or indirectly, for example by indirect engagement via a portion of the tool body structure which is slightly resiliently or elastically deflectable, to thereby, indirectly, transfer clamping force to the respective cutter element.

The arrangement has the advantage that, by suitable choice of the eccentricity of the eccenters, and matching the eccentricity to the shape of the clamping or holding grooves, or, respectively, the clamping or holding surfaces of the grooves and the matching surfaces of the cutter strips, extremely high clamping forces can be obtained which can be easily applied and, selectively, again released.

In one and preferred embodiment, each one of the cutter strips has an associated eccenter with a degree of eccentricity such that the eccenter, when rotated and placed in clamping position, is self-holding or self-locking. The eccenter acts either directly on a suitable fitting surface of the cutter element or on a clamping portion of the body structure. The rotatable eccenter, for clamping, or release, respectively, requires rotation only about a fraction of a revolution, and the actual clamping engagement arrangement can be simple. Threads and the like, which are subject to damage, need not be used.

It is readily possible to clamp the cutter strips in the longitudinal groove by a mere friction clamping fit. Usually, however, and in accordance with a preferred feature, it is of advantage to additionally support the clamping elements in the longitudinal grooves on the clamping surfaces in interlocked position within the grooves of the base body structure. In one embodiment of the invention, the eccenter of the clamping system directly engages support and clamping surfaces formed on the cutter elements as such. At the trailing side—with respect to the direction of rotation of the rotary tool body—the clamping surface formed at one of the grooves is inclined with respect to a radial direction thereof, so that it will form an interlocking fit with the cutter strip when the eccenter locks the strip in position. Supporting the cutter strips at the back side provides for particularly effective transfer of forces applied to the cutter elements when they are cutting. In accordance with another feature of the invention, each one of the longitudinal grooves may be formed with both side surfaces being inclined towards each other, with respect to a radially outwardly extending direction. The cutter elements are formed with equally tapering engagement regions or surfaces so that the cutter elements are retained in the grooves in an interlocking fit, to be then clamped in position by rotation of the eccenter.

Direct engagement of the cutter elements, in the bottom or root region thereof, with the eccenter may require special shaping of the cutter elements. In many installations, however, it is desirable to use cutter elements which are of simple shape which can be constructed in particularly economic form by providing two cutter edges thereon, that is, permitting the cutter elements to be essentially mirror-symmetrical in a width direction so that, when one cutting edge of the cutter elements becomes dull or worn, the cutter elements can merely be turned over to provide a new sharp cutting edge. Turning over the cutter element, of course, requires removal from the body structure and the simple loosening of the eccenter permits rapid axial removal of the cutter elements, turning them over, and reinstallation. Reversible cutter elements are preferably placed into grooves which, at least at one side, are formed with a clamping element movably secured or forming a movable part of the body structure. In one preferred form, the movable part is a resiliently deflectable portion of the body structure, resiliently deflectable by rotation of the eccenter It can be located at the trailing side of the groove, supported by the eccenter. In accordance with a preferred feature of the invention, the clamping portion can be unitary with the body structure, and coupled via an elastically deformable region with the remainder of the body structure. It can be located at the trailing or rear side, with respect to the direction of rotation, or at the leading side. The resiliently deflectable portion can be located in a suitable bore, formed for example at the outer circumference with a longitudinal slit, into which the eccentric clamping element is located. This permits particularly simple manufacture of the body structure and the clamping element

DRAWINGS

FIG. 4 is a fragmentary side view of another embodiment of cutter elements and eccentric holding arrangements therefor;

FIGS. 6 and 7 are side views of holding elements, used in the cage structure of FIG. 4, to different scales.

DETAILED DESCRIPTION

Figure 1:
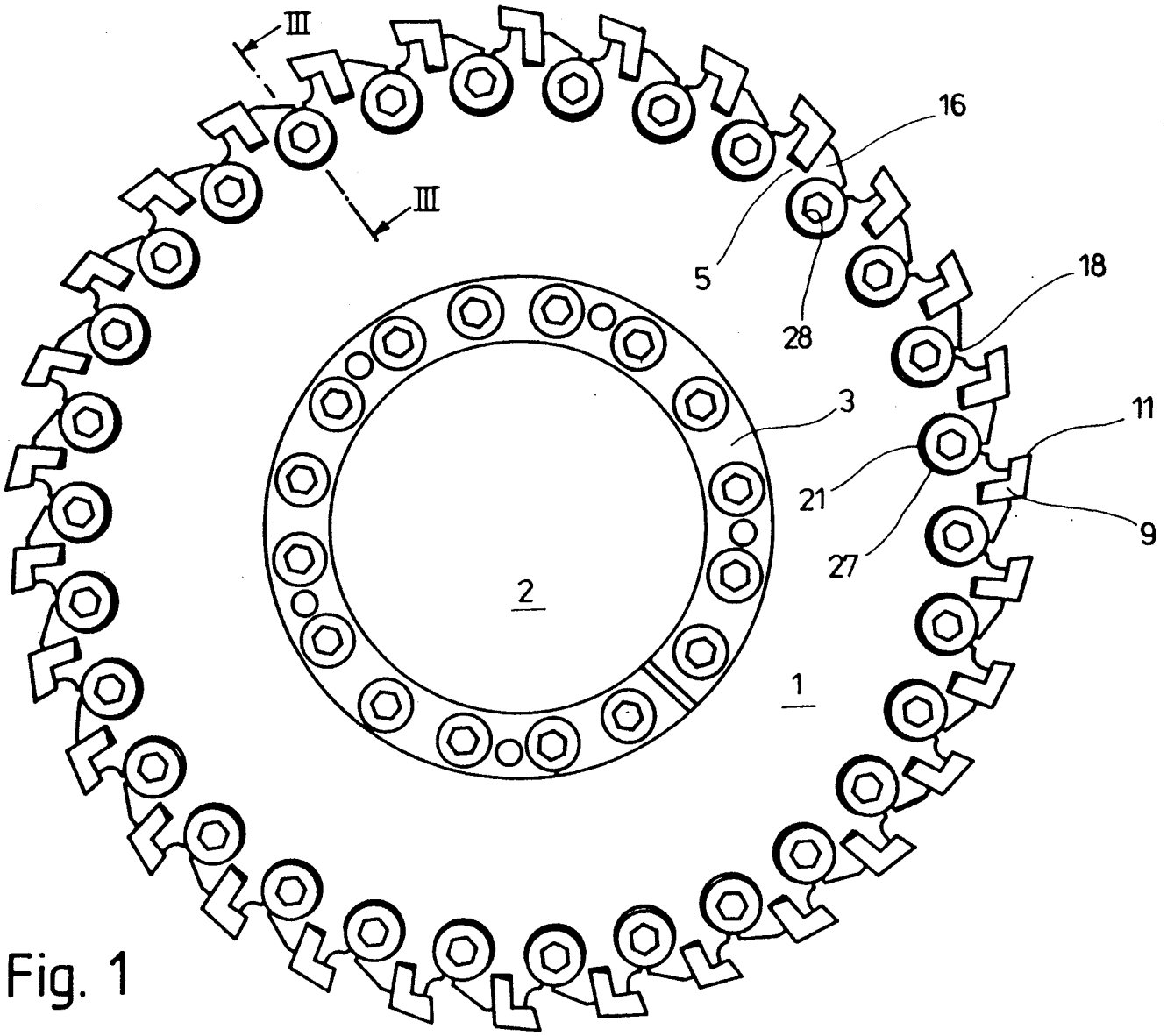
FIG. 1 is an end view of a cutter tool.
Figure 2:
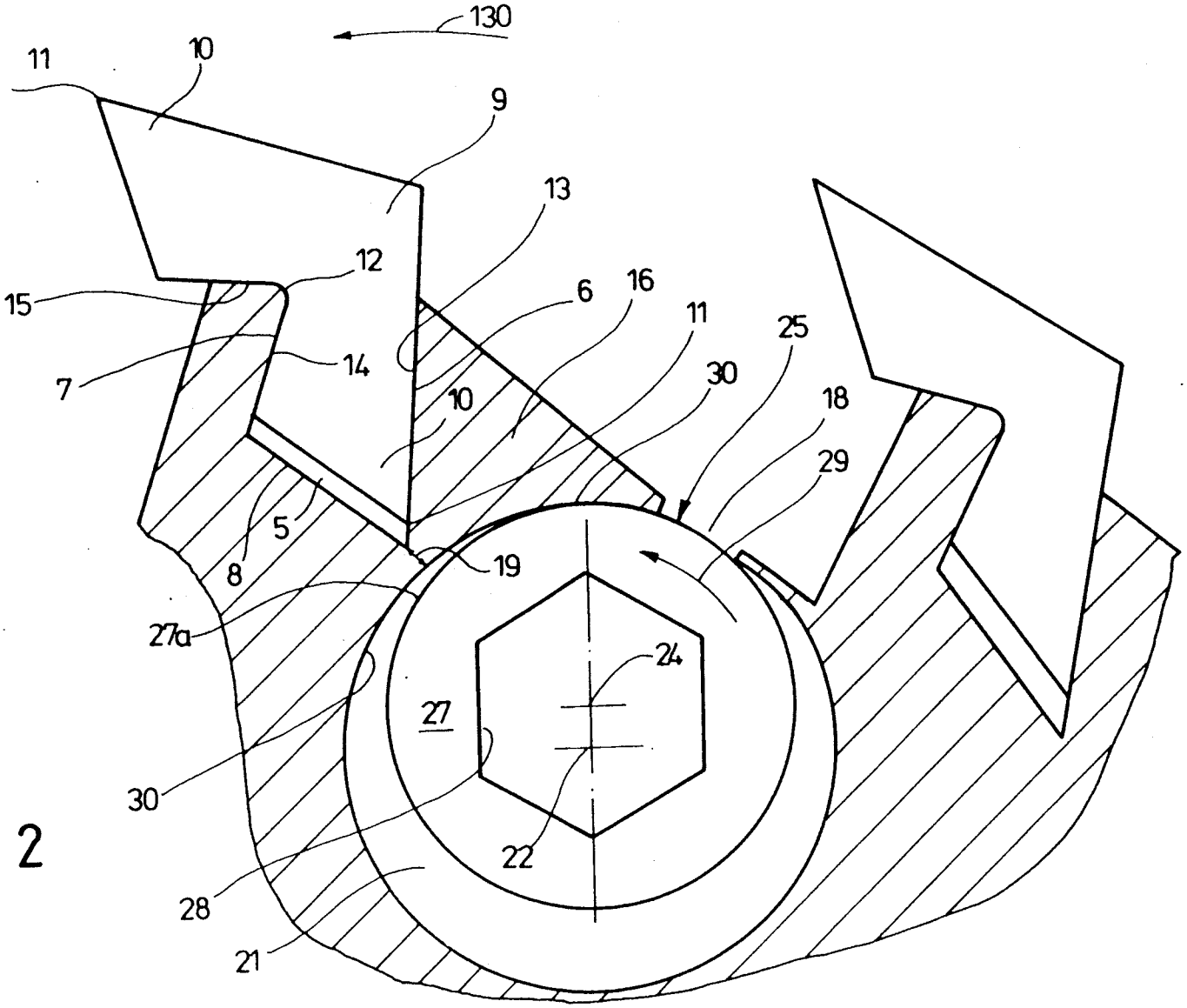
FIG. 2 is a fragmentary highly enlarged part-sectional view looking in the same direction as the end view of FIG. 1, and illustrating two successive cutter elements located and clamped in a groove.
Figure 3:
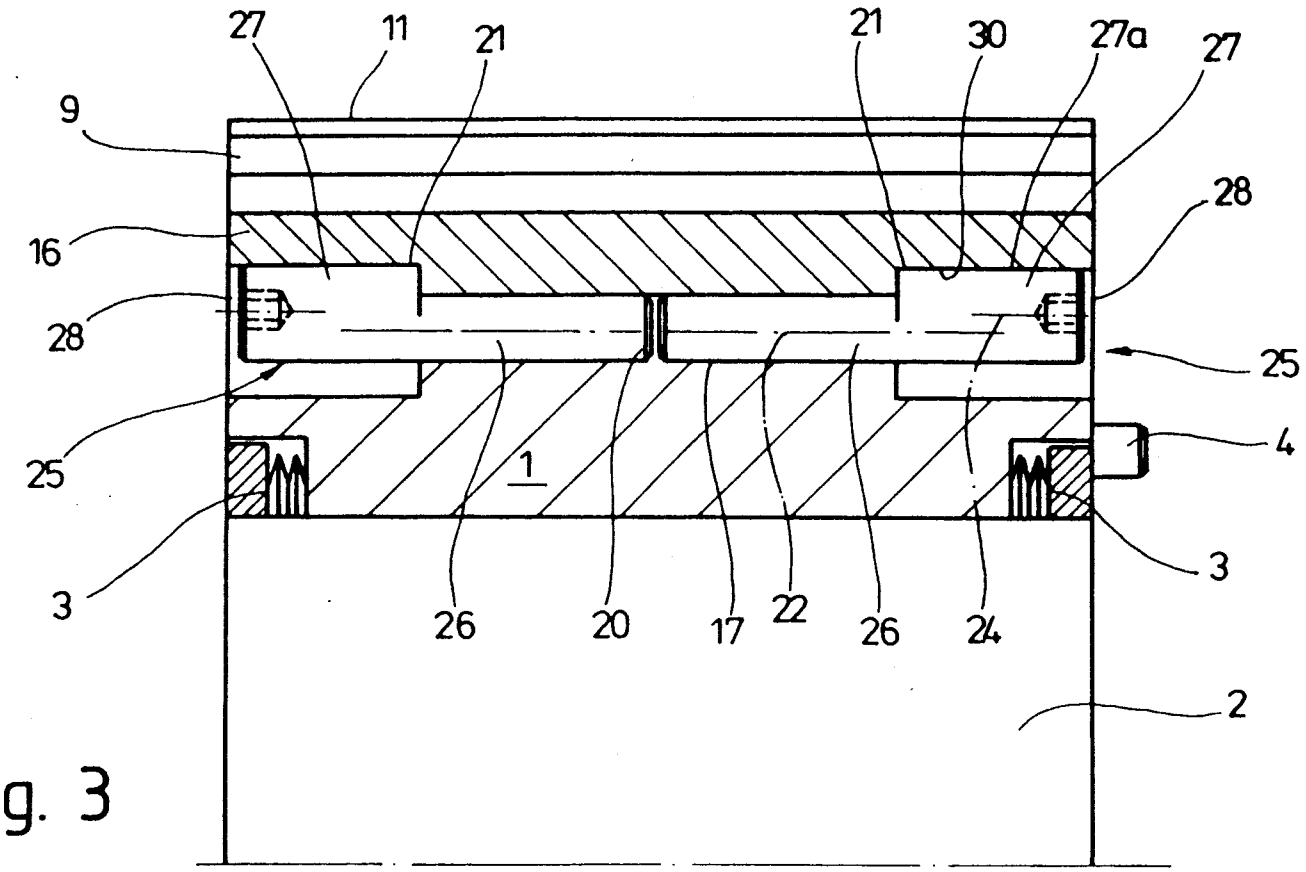
FIG. 3 is an axial half cross-sectional view of the structure of FIGS. 1 and 2, taken on line III—III of FIG. 1, and to a scale intermediate that of FIGS. 1 and 2.
Figure 5:
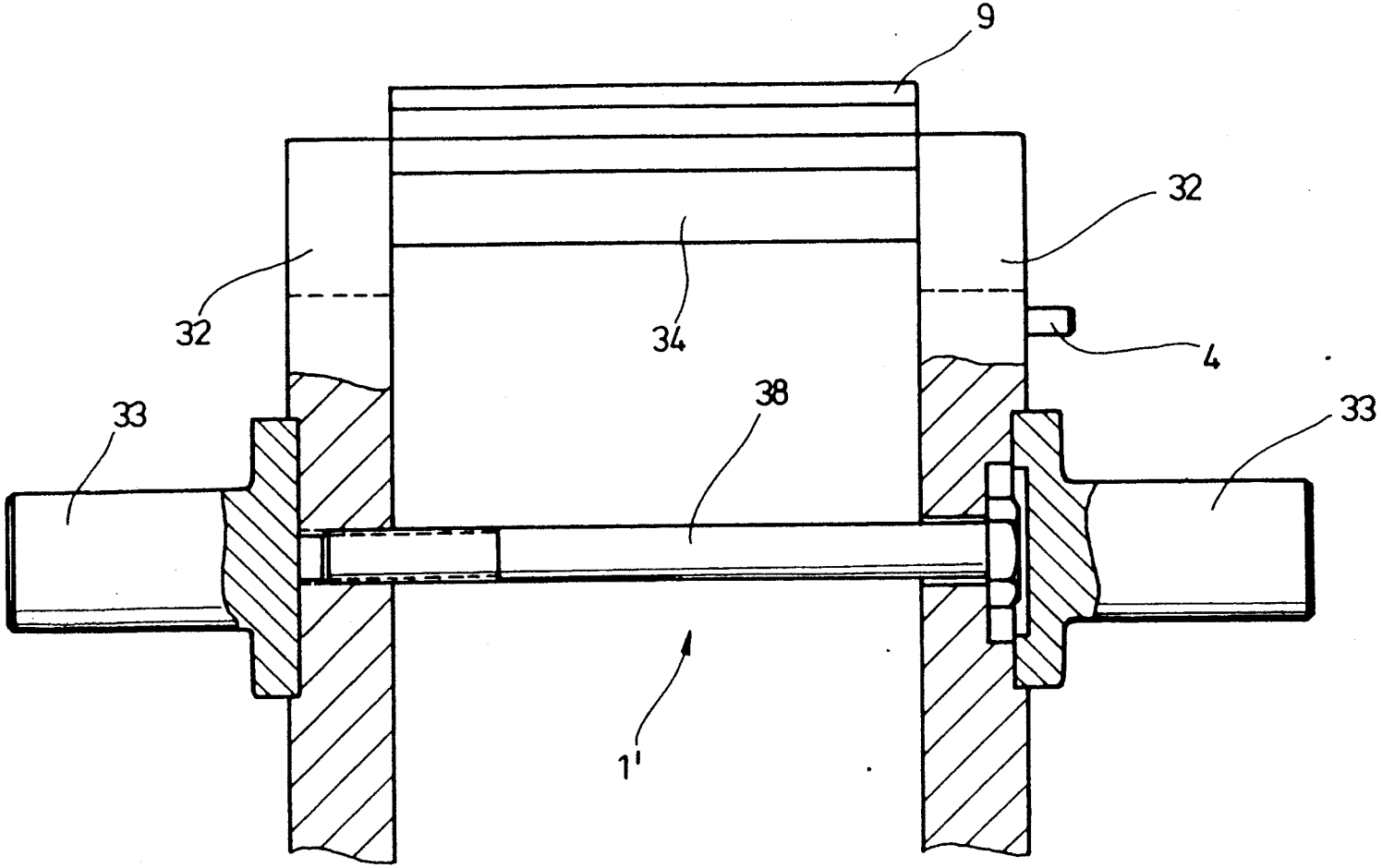
FIG. 5 is a longitudinal part-sectional view illustrating another form of cutter body, partly cut away, and omitting features not necessary for an understanding of the invention, in which the cutter body is a "cage" structure.

Referring first to FIGS. 1, 2 and 3:

The cutter has a body structure 1 which, in FIGS. 1 to 3, is illustrated as a solid, essentially cylindrical structure made, for example, of steel. Body 1 is formed with a coaxial through-bore 2, forming a hub, in order to receive a shaft (not shown) to rotate therewith. Circumferential clamping elements 3 are located on the body 1, close to the bore 2, to clamp the body 1 to the shaft. The cylindrical body 1 can be coupled to similar cylindrical bodies, axially adjacent thereto, and to ensure fit and synchronous rotation, the body 1 is formed with projecting pins 4, only one of which is shown in FIG. 3, so that a plurality of cutter units can be assembled together into a cutter tool of substantial axial length. The pins 4 fit into matching holes at the other end face (with respect to FIG. 3) of the body 1.

The body 1 is formed with a plurality of circumferentially uniformly spaced, essentially axially extending longitudinal grooves 5 (FIG. 1). The grooves 5 are inclined with respect to a radial plane passing through the axis of rotation of the body 1 by an angle of about 2° to 3°. The slight inclinated decreases the noise level when the tool is in operation. Since the angle is small, the grooves can be referred to as extending "essentially" axially, it being understood that, preferably, they do not extend precisely in axial direction. The grooves 5 are bounded by two side walls 6, 7 and a bottom wall or root 8. The side walls 6 and 7 may, for example, be parallel; in accordance with a preferred feature of the invention, the side walls 6 and 7 are, radially outwardly, inclined towards each other. The slot formed by the opening of the grooves at the circumference of the body 1, thus, is narrower than the wall 8 at the root of the groove.

A cutter element 9 is located in each one of the grooves 5. To assemble the cutter element, it is pushed axially into the groove. The cutter element has an essentially L-shaped cross section. The two legs 10 of the L-shaped cutter element include an angle of about 105°. The legs 10 of the cutter element are formed with cutting edges 11 at the ends thereof, extending over the entire length of the respective cutter element. The cutting edge 11 is wider than the root portion 12 of the respective cutting element 9, that is, the cross section of the cutter elements 12 expand towards the cutting edge, as clearly seen in FIG. 2. The dimensions are so selected that the cross section of a groove 5 and the cross section of the leg 10 of the cutter elements 9 correspond. Thus, when the cutter element is axially inserted into the groove, the lateral surfaces 13, 14 of the cutter element in the groove form support surfaces which engage against the side walls 6, 7 of the groove. Due to the wedge-like shape of the groove 5, they are held in an interlocking fit with respect to radial or centrifugal forces. Additionally, the body 1 is formed with an accurately machined engagement surface 15 which is forward or leading with respect to the direction of rotation shown by arrow 130 in FIG. 2. This surface 15 forms an engagement and stop surface for the upper leg 10 of the cutter element, thereby precisely placing the respective cutter element on the body and into the groove 5. Thus, each cutter element 9 is in precisely reproducible position in the respective groove 5 of the body 1. The depth of the longitudinal grooves 5 is so selected that the leg 10 of the cutter element 9 which is in the groove does not extend all the way down to the root wall 8, but leaves a little clearance, as clearly seen in FIG. 2.

Each one of the longitudinal grooves 5 has an individual clamping arrangement associated therewith for the respective cutter element 9.

In accordance with a feature of the present invention, the clamping element to clamp the cutter element 9 in position comprises an eccentric structure. The eccentric structures permit rapid tightening or loosening of a cutter element 9 by rotating a suitable tool only over a fraction of a revolution. The clamping element, thus, permits rapid servicing from the outside of the cylindrical body 1 to, respectively, lock or release any one of the cutter elements In accordance with a feature of the invention, the clamping elements of FIGS. 1–3 include a clamping portion 16 of the body 1, which is located, with respect to the direction of rotation 130, at the trailing or hind side of the respective cutter elements. The leading side of the clamping element is formed by the side wall 6 of the groove. A through-bore 17, of stepped cross-sectional dimension, as best seen in FIG. 3, is formed in the body 1. The through-bore 17 is accessible from the outside by a longitudinal slit 18 formed in the circumference of the body 1. The slit 18 permits the clamping element or portion 16 to elastically deflect about a narrow root portion 19 (FIG. 2).

The stepped through-bore 17 has an inner first cylindrical portion 20. Blind elongated bores 21, eccentric with respect to the bore 20, extend from both facing sides of the body 1 into the through-bore. The axis 22 of the blind bores 21 is offset with respect to the axis 24 of the throughbore 20, of the clamping portion 16 in body 1, see FIG. 2 and 3. Two similar eccentric clamping elements 25 are fitted into the stepped bores 17, and form portions of the clamping arrangement.

Each one of the eccenters 25 has a cylindrical element 26, rotatably located in the first bore portion 20, to which an eccenter part or head 27 of larger diameter is joined adjacent the facing ends. The larger part 27 has axial play and is positioned in the second bore portion of enlarged diameter 21. The eccenter element or head 27 has an engagement surface 27*a*; element 27 is formed with an Allen wrench socket 28 to permit rotation thereof about the axis 24.

Operation, with reference to FIG. 2:

Cutter elements 9 are axially slid into the grooves 5 of the body 1. The clamping elements 25 are loose. Thereafter, and when the cutter elements are seated against the engagement or abutment surface 15, the respective clamping elements 25 are rotated in the direction of the arrow 29 (FIG. 2). The engagement surface 30 formed at the wall of the respective bore 21 will come into engagement with the eccenter engagement 27*a*, on eccenter lead 27, so that the clamping element 16, with reference to FIG. 2, is slightly tipped or tilted or pivoted in counter-clockwise direction about the root portion 19 thereof. Consequently, the groove side walls 6, 7, which will then function as clamping surfaces, will clamp the respective leg 10 by engagement with its engagement surfaces 13, 14 to securely hold and clamp the cutter element 9 in the respective groove 5.

To obtain reliable and secure clamping, it is sufficient when the two cutter elements 25 are rotated about a fraction of a revolution. The geometrical relationships are so selected that, when the eccenter head 27 is rotated, the circumferential surface 27*a* of the eccenter head 27 and the associated counter engagement surface 30 of the body portion 16 are self-locking or self-holding. This then locks the clamping element in position.

Rather than using a hexagonal Allen-type socket, other engagement recesses to rotate the eccentric element 27 may be used.

When the cutting edges 11 of the cutter elements which are exposed to the cut, granulate, comminute or shred material to which they are exposed and become worn or dull, or if a cutter element should be replaced, it is merely necessary to rotate the associated clamping elements 25 in counter rotation from the clamping position shown in FIG. 2 to such an extent that the eccenter portion 27 of the clamping elements 25 releases the engagement surface 30. The clamping portion 16 of the body 1, due to its inherent elasticity, will then return into released position, permitting axial removal of a cutter element.

The cutter elements 9 are made of hard metal, high-speed carbon steel, stellite or the like, and are formed as reversible cutter elements, that is, after one edge 11 becomes dull, they can merely be reversed end-for-end, so that the leg 10 previously in the groove is then placed in the exposed position shown in FIG. 2, and the dull edge fitted in the groove. Thus, the two cutting edges 11 can operate successively. The eccenters 27, fitted from both sides into the bore 17, can be coupled together at their inner shaft ends, so that rotation from one side only is necessary, although for comparatively long bodies, rotation of the eccenters 27 from both sides is preferable to ensure axially uniform application of clamping force. The eccenters can be held in the respective bores in any suitable manner, for example by C-rings in grooves, as well known, and therefore not shown.

The cutter elements can be formed in a different manner, and FIGS. 4 and 7 show a different arrangement in which eccenters 27 directly engage the eccenter surfaces 27*a* on counter surfaces of the cutter elements. The strip-like cutter elements 90 have only one cutting edge. The cutting edge 11 is formed somewhat differently by extending straight outwardly. The opposite end of the cutter element 90 is branched into two generally diverging inclined legs 100, forming a shallow V. The groove walls 6, 7 converge towards the outer circumference of the body 1 and, therefore, the cutter elements 90 are held in interlocked engagement in the grooves 5. The legs 100 define shallow V or roof-like counter engagement surfaces 300. The individual sides thereof include an angle of about 120°.

The stepped bore 17 (FIG. 3) is located beneath the bottom surface of the groove 5, preferably roughly centrally with respect to the wall bottom 8, and so located that the two bore portions 21 are open towards the longitudinal groove 5. A clamping element 25, axially introduced into the stepped bore 17, thus places the eccenter parts 27 directly against the roof-shaped engagement surfaces 300 of the associated cutter element 90.

In operation, and starting from a released position, and with a cutter element 90 inserted in the groove, the two clamping elements 25 are rotated into clamping position to thereby engage the eccenter counter surface 27*a* on eccenter head 27 of the associated clamping elements against the counter surface 300. With respect to the direction of rotation 130, the respective cutter 90 is tightly engaged with its back wall 100' and the forward wall 100'', and thus clamped in the groove 5 by the converging shape of the side walls 6, 7 thereof.

The eccenter portions or heads 27 are so arranged that, in association with the counter engagement surface 300 of the cutter element, they are self-locking, or self-positioning. Again, the cutter elements 90 are thus tightly and properly positioned by the self-locking arrangement.

Figure 8:
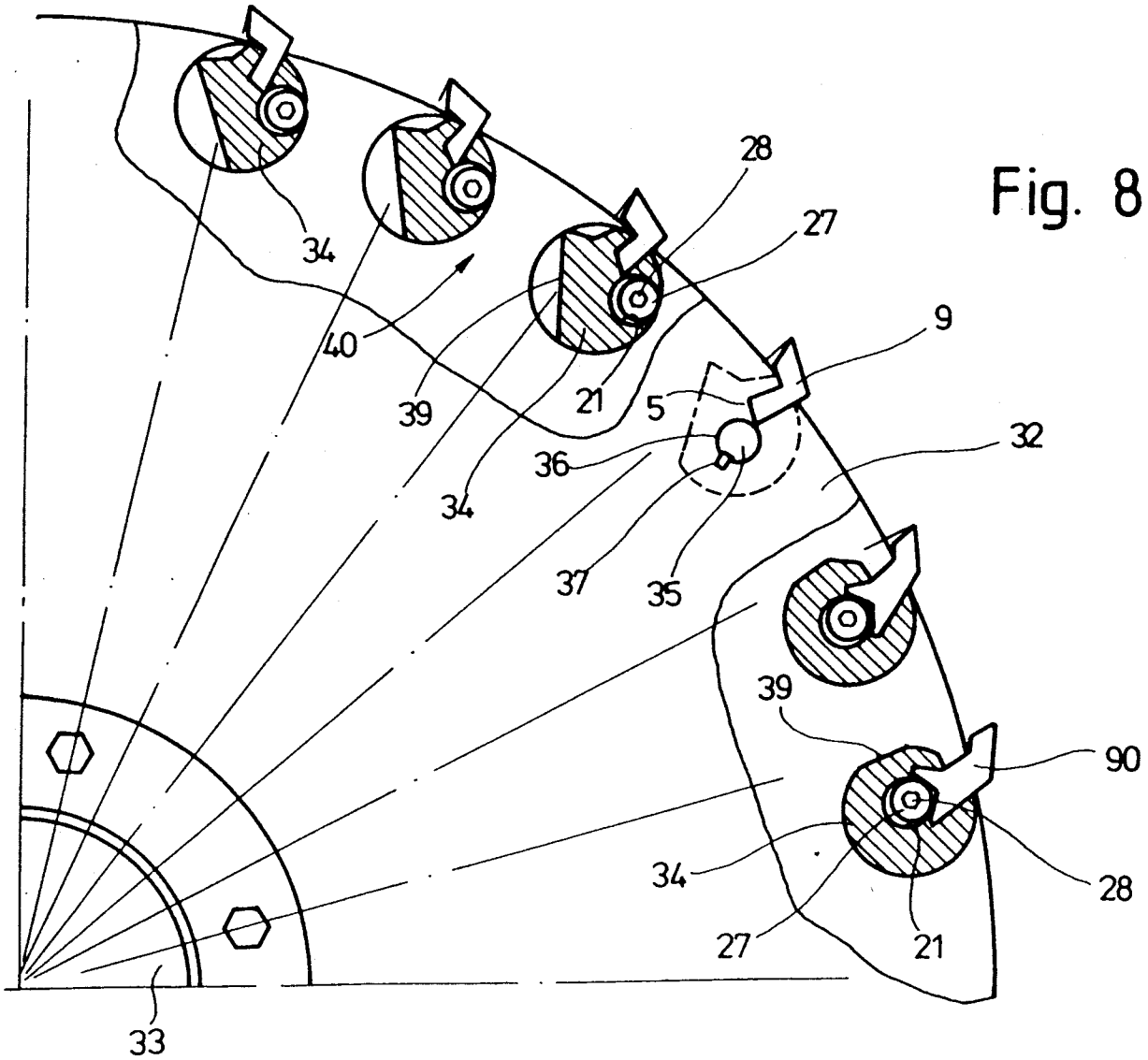
FIG. 8 is a fragmentary end view, partly in section, of the cutter tool using the cage structure of FIG. 5 and illustrating a composite structure with some cutter elements constructed as shown in FIG. 6 and others constructed as shown in FIG. 7.

Embodiment of FIGS. 5 to 8:

The tool body 1', in accordance with the embodiment illustrated in FIGS. 5 to 8, is not a solid body but, rather, a cage structure. It has two lateral disk or spider elements 32, similar to flanges or bearing plates in short, collectively wheel-like elements, which carry coaxial bearing stubs or hub stubs 33. A plurality of rod or rail-like reception elements 34 are located in the region of the circumference of the cage body 1'. The rod or rail elements are, in cross section, essentially at least part-cylindrical rods, which are uniformly distributed along the circumference of the tool body 1', as best seen in FIG. 8. The cylindrical elements 34 carry the respective cutter elements 9 or 90. At their facing ends, they are formed with cylindrical attachment bolts 35 (FIG. 8) which fit in corresponding bores 36 formed in the disks or bearing plates 32. A spline or rocker 37 prevents relative rotation of the bolt or rail 35 in the bore 36. A threaded bolt 38 locks the two disks or flange plates 32 together, and hence locks the bolts or rails 34 in position.

Each one of the bolts or rails 34 forms a receiving element for a cutter blade. Thus, the bolts or rail elements 34 are formed with the longitudinal groove 5 and, in turn, has the stepped bore 17 (FIGS. 2, 3) and the rotatably located eccenter elements 25 therein. The cutter elements 9 or 90 may be used, provided the associated groove 5 is suitably shaped to receive cutter elements; differently shaped cutter elements, likewise, may be used. Thus, the groove 5 may be formed as shown in FIG. 2 or 3 or as shown in FIG. 4. Similar parts, insofar as they are identical, have been given the same reference numerals as in FIGS. 2 and 4. In operation, the cutter elements 9 or 90 are clamped, as previously described.

The cage-like construction of the tool body 1' provides for free space 40 between adjacent receiving elements 34, which permits granulate, cut elements or the like to fall into a receptacle or the like, which can receive granulate coming from various circumferential positions of the cutter elements along the circumference thereof, when the cutting tool is used as well known, and described, for example, in German Patent 27 24 464. As known, and as described in the aforementioned German patent, the cutter elements receive strips, strings or "spaghetti" of material to be granulated over supply ducts or channels which are angularly offset with respect to each other and have different supply angles. Thus, the cutter elements can cut on various positions along their their circumference, so that the axial length of the overall structure can be held to a reasonable dimension.

To ensure that granulated or shredded material can fall freely through the interstices between adjacent bar or rod elements 34, the elements 34 are not completely cylindrical but only partially cylindrical, and formed with flat surfaces 39, see FIGS. 6 and 7, parallel to the axis of rotation of the body 1' to provide for free spaces 40 of sufficient size to permit the shredded material to freely pass therethrough.

FIGS. 6 and 7, additionally, show, to an enlarged scale, the respective elements 34 which are used with different cutters 9, 90, which can all be assembled on one body 1', as seen in FIG. 8.

The tool body, of course, can have various shapes and be made of various axial lengths. In one form, it is a solid cylindrical structure 1 (FIGS. 1–3, FIG. 4) in which the longitudinal grooves 5 are formed directly within the circumferential portion of the solid body. Thus, the cutter elements 9, 90 can be directly fitted on the solid body 1. The eccenter elements are longitudinal structures which engage against the longitudinal body portions 16. These body portions, thus, form part of the tool body. The eccenter elements are held, at least in the region of their end faces, in suitable recesses of the body, and are axially retained in position. In another construction, a cage is formed, see FIGS. 5–8, with bearing elements 33 located adjacent the end faces of the cage disks or plates. The cage disks or plates are axially secured together, for example by a central bolt 38 or a plurality of bolts. Rather than using end plates 32, star or spider elements may be used. The coupling pin 4 (FIGS. 3,5) permits coupling similar cage elements to each other and ensures synchronous rotation, about one or a plurality of suitable shafts or stub shafts.

The bolt or rail elements 34, preferably formed with the relief surface 39 (FIGS. 6, 7) are part-cylindrical, each one having an axially extending longitudinal groove and an associated clamping arrangement to clamp the cutter elements 9 or 90. The space between adjacent receiving bolts 34, then, will have an open, rotary cage-like configuration, so that the entire tool body will be internally open. The spaces 40 between adjacent bolts 34, and the cutter elements 9, 90 inserted therein, then permit to supply ribbon, spaghetti, or strand or filamentary material, for example of thermoplastic material to be granulated, with the supply positions of various circumferentially offset locations. The thermoplastic elongated material thus can be granulated and the utility of the tool increased so that the throughput can be increased without requiring axial extension of the cutter tool body. Cutting positions which are above a horizontal plane can pass through the open spaces 40 and between the rail elements 34 of the cutter tool to be collected in a receptacle below the cutter tool.

In accordance with a preferred feature of the invention, the region at the edge of the respective groove 5 is formed with an abutment or locating surface, such as the surface 15 (FIG. 2) to determine the radial position of the respective cutter elements. Forming an abutment or locating surface on the solid tool body 1, or on the rail or strip element 34, facilitates assembly of a cutter element 9, 90 into the tool body, and/or surface grinding of the entire cutter element, as well as replacement of a cutter element and/or turn-over of a cutter element 9. To obtain greater axial length, a plurality of tool bodies can be coupled together in which, then, and for effective clamping arrangement, each of the tool bodies 1, 1', respectively, have their own eccenter clamping arrangement.

Various changes and modifications may be made, and any features described herein may be used with any of the others, within the scope of the inventive concept.

I claim:

1. Rotary cutter tool, particularly for granulating plastic material, comprising an axially elongated, essentially cylindrical body structure (1, 1') formed with a plurality of essentially axially directed, substantially uniformly distributed grooves (5);

a plurality of elongated, selectively removable cutter elements (9, 90) located in the respective grooves (5), wherein the grooves (5) are formed with essentially flat groove side surfaces (6, 7); and further comprising clamping means (25, 27, 30, 300) for selectively releasably clamping said cutter elements (9, 90) in said grooves (5) and against said surfaces (6, 7), said body (1, 1') including means (16, 17, 20, 21) for retaining said clamping means coupled to said body, said clamping means including, a plurality of rotatable eccenter elements (25, 27) each formed with an eccenter engagement surface (27*a*) thereon, a plurality of counter engagement surfaces (30, 300) each, engageable by said eccenter engagement surface (27*a*) formed on at least one of:

said cutter elements (90); and said clamping elements (90); and said clamping means retaining means (1, 1', 16);

said eccenter engagement surfaces (27*a*) and said counter engagement surfaces (30, 300) being relatively positioned, dimensioned, and oriented with respect to each other to provide for self-locking or self-holding of the rotatable eccenter elements against the associated counter engagement surfaces when a respective eccenter element is in locked engaged position against a respective associated counter engagement surface.

2. The tool of claim 1, wherein said eccenter elements (25, 27) are in direct engagement with said cutter elements (90).

3. The tool of claim 1, wherein said means for retaining the clamping means includes a plurality of bores (17, 20, 21) formed in said body structure (1) each positioned with respect to said grooves (5) to define a plurality of elastically deformable or deflectable body portions (16) between each of said grooves (5) each of said bores (17, 20, 21) said, deflectable body portions (16) engaging the cutter elements; and wherein, the eccentric elements are in engagement with said elastically deformable or deflectable portions, whereby said eccentric elements are indirectly coupled to said cutter elements by indirect force transfer thereto.

4. The tool of claim 1, wherein said means (16, 17, 20, 21) for retaining said clamping means comprises force transfer means (16) for coupling said eccentric elements (25, 27) to said cutter elements (9, 90), whereby said eccentric elements are indirectly coupled to said cutter elements for indirect force transfer to the cutter elements upon rotation of the eccentric elements.

5. The tool of claim 1, wherein said eccentric means comprises a rotatable eccenter element (27);

and wherein said counter engagement surfaces (30) are formed on said body structure (1, 1'), said counter engagement surfaces (30), being engageable by said eccentric engagement surface (27*a*) on said rotatable eccenter element (25, 27) upon eccentric rotation thereof, said rotatable eccenter elements and said counter engagement surfaces on said body structure (1, 1') being matched to each other to provide for self-locking or self-holding of the rotatable eccenter element when in locked engaged position against said counter engagement surface.

6. The tool of claim 1, wherein said eccentric means comprises a rotatable eccenter element (27);

and wherein said cutter elements (90) are formed with a cutter portion (100) defining said counter engagement surfaces (300), engageable by said eccenter elements (27) upon eccentric rotation thereof, said eccenter elements and said counter engagement surfaces in the cutter elements being matched to each other to provide for self-locking or self-holding of said rotatable eccenter elements when in locked, engaged position against said counter engagement surfaces.

7. The tool of claim 1, wherein said cutter elements comprise elongated strip or rail elements (9, 90) having lateral engagement surfaces (13, 14);

and wherein said essentially flat side surfaces (6, 7) of the grooves (5) and said lateral engagement surfaces (13, 14) of the cutter elements are shaped to provide an interlocking assembly of said strip elements in said grooves.

8. The tool of claim 1, wherein said tool body (1, 1') includes elongated reception holding rods (34);

and wherein said clamping means are formed in said elongated holding rods (34).

9. The tool of claim 8, wherein said cylindrical body (1, 1') defines a pair of end walls 32; and wherein said elongated reception holding rods (34) are secured to said end walls.

10. The tool of claim 9, wherein said end walls comprise wheel means;

and said elongated reception holding rods (34) are located at circumferential regions of said wheel means.

11. The tool of claim 10, including means (37) for retaining said elongated reception rods in the wheel means (32) while inhibiting relative rotation of said reception rods and said wheel means.

12. The tool of claim 8, wherein said elongated reception rods (34) are, in cross section, part-cylindrical elongated elements;

and wherein each one of said part cylindrical elongated element is formed with at least one of said grooves (5) and includes the clamping means, said clamping means being associated with said at least one groove.

13. The tool of claim 1, wherein said essentially cylindrical body structure (1, 1') defines a pair of oppositely located end faces;

and wherein at least one of said end faces is formed with means (4) projecting therefrom and located eccentrically with respect to the axis of rotation of said essentially cylindrical body structure for engagement with a similar body structure for axially aligned placement thereagainst, and transfer of rotation between said axially aligned body structures.

14. The tool of claim 1, wherein at least one of the cutter elements (90) has a holding portion located in the groove (5), said holding portion (100) being formed with an engagement surface (100');

wherein at least one of the essentially flat groove side surfaces (6, 7) is inclined with respect to a radial plane extending from the center of rotation of said cylindrical body structure; and wherein said clamping means forces said engagement surface to engage the engagement surface (100') against said at least one inclined side surface (6) of the groove.

15. The tool of claim 14, wherein upon rotation of said cylindrical body structure (1, 1') the grooves (5) each define a rearward or trailing side surface; and wherein, said at least one side surface (6) is formed by the rearward or trailing side surface.

16. The tool of claim 1, wherein said essentially flat-side surfaces (6, 7) are inclined towards each other with respect to a radial plane extending from the center of rotation of said cylindrical body structure (1, 1'); and wherein said cutter elements are formed with engagement surfaces having similar angles of inclination as the inclined side surfaces to define engagement surfaces (13, 14; 100', 100'') fitting against said side surfaces (6, 7).

17. The tool of claim 1, including a clamping portion (16) forming one of said side surfaces (6) of the groove, said clamping portion having limited deflectability or deformability;

and wherein said clamping means (25) is engageable with said clamping portion from a side thereof remote from said side surface (6).

18. The tool of claim 17, wherein said clamping portion is unitary with said cylindrical body structure (1) and joined thereto by an elastically deformable region (19).

19. The tool of claim 17, wherein upon rotation of said cylindrical body structure (1, 1') the grooves (5) each define a rearward or trailing side surface; and wherein the clamping portion is adjacent the trailing side surface.

20. The tool of claim 1, wherein the means for retaining said clamping means includes a plurality of axially extending bores (17) (20, 21) formed in said body structure, said eccenter elements means (25) being located in said bores; and axially extending slits (18) connecting said bores with the circumference of said cylindrical body structure (1, 1') to permit elastic deformation of a portion of said body structure adjacent said slit.

21. The tool of claim 1, wherein said cutter elements comprise elongates trip elements having two cutting edges (11) thereon, to permit turn-over of the cutter elements and sequential use of the edges.

22. The tool of claim 1, wherein said body structure (1, 1') comprises abutment means (15) engageable by a portion of a respective cutter element (9) for accurately positioning the respective cutter element on the cylindrical body structure.

23. The tool of claim 1, wherein said body structure comprises a cage structure including a pair of elements including at least one of end plates, (32), and axially extending elongated reception holding rods (34), and axially extending elongated reception holding rods (34), said reception holding rods being non-rotatably retained in said end plates, each rod being formed with one of said grooves (5), said rod being located, circumferentially, spaced from each other to leave a free space (40) between adjacent rod for passage of granulated or shredded material therebetween.

* * * * *